US010207779B2

(12) United States Patent
Best

(10) Patent No.: US 10,207,779 B2
(45) **Date of Patent: *Feb. 19, 2019**

(54) INFLATION DEVICE WITH MEANS FOR PREVENTING THE REMOVAL OF THE GAS CONTAINER

(71) Applicant: Michael E. Best, Totton Southhampton (GB)

(72) Inventor: Michael E. Best, Totton Southhampton (GB)

(73) Assignee: United Moulders Limited, Farmham Surry (GB)

( * ) Notice: Subject to any disclaimer, the term of this patent is extended or adjusted under 35 U.S.C. 154(b) by 0 days.

This patent is subject to a terminal disclaimer.

(21) Appl. No.: 15/341,434

(22) Filed: Nov. 2, 2016

(65) Prior Publication Data

US 2017/0190400 A1 Jul. 6, 2017

Related U.S. Application Data

(63) Continuation of application No. 13/884,224, filed as application No. PCT/GB2011/001582 on Nov. 10, 2011, now Pat. No. 9,499,244.

(30) Foreign Application Priority Data

Nov. 11, 2010 (GB) ..... 1019053.6

(51) Int. Cl.

| | |
|---|---|
| ***B63C 9/19*** | (2006.01) |
| ***B63C 9/18*** | (2006.01) |
| *B63C 9/00* | (2006.01) |

(52) U.S. Cl.
CPC ..... *B63C 9/19* (2013.01); *B63C 9/18* (2013.01); *B63C 2009/007* (2013.01)

(58) Field of Classification Search
CPC .... B63C 2009/0023; B63C 2009/0029; B63C 2009/0035; B63C 2009/0041;
(Continued)

(56) References Cited

U.S. PATENT DOCUMENTS

| | | | |
|---|---|---|---|
| 3,042,946 | A | 7/1962 | Davis et al. |
| 3,046,575 | A | 7/1962 | Davis et al. |

(Continued)

FOREIGN PATENT DOCUMENTS

| | | | |
|---|---|---|---|
| JP | 55-051696 | A | 7/1979 |
| JP | 2008-302729 | A | 12/2008 |

OTHER PUBLICATIONS

Translation of office action for 2013-538261, Oct. 27, 2015, Supplied in Parent Case.

(Continued)

*Primary Examiner* — Andrew Polay
(74) *Attorney, Agent, or Firm* — Clifford H. Kraft

(57) ABSTRACT

An inflation device for an inflatable article comprises a housing for supporting a container of pressurized fluid and for supporting piercing means which is displaceable from a retracted position to penetrate the container and allow release of pressurized fluid, said container being contained within a protected casing which is secured non-releasably to the housing thereby to prevent removal of the pressurized container.

18 Claims, 6 Drawing Sheets

(58) Field of Classification Search
CPC .... B63C 2009/0047; B63C 2009/0052; B63C 2009/0058; B63C 2009/0064; B63C 2009/007; B63C 2009/0076; B63C 2009/0082
See application file for complete search history.

(56) References Cited

U.S. PATENT DOCUMENTS

| | | | | |
|---|---|---|---|---|
| 3,173,162 | A * | 3/1965 | Elder, Jr. | B63C 9/23 441/94 |
| 4,260,075 | A * | 4/1981 | Mackal | B63C 9/18 222/5 |
| 4,629,436 | A | 12/1986 | Stewart et al. | 441/93 |
| 4,815,677 | A | 3/1989 | Rushing et al. | 244/33 |
| 5,820,431 | A | 10/1998 | Biesecker | 441/94 |
| 6,004,177 | A | 12/1999 | Biesecker et al. | 441/92 |
| 8,113,897 | B2 | 2/2012 | Hanson | 441/96 |
| 2003/0049981 | A1 * | 3/2003 | Mackal | B63C 9/18 441/92 |
| 2007/0089655 | A1 | 4/2007 | Olsen et al. | |

OTHER PUBLICATIONS

Letter from JP law firm RE office action 2013-538261, Nov. 30, 2015, Supplied in Parent Case.

* cited by examiner

INFLATION DEVICE WITH MEANS FOR PREVENTING THE REMOVAL OF THE GAS CONTAINER

This is a continuation of application Ser. No. 13,884,224 filed May 8, 2013 which was a U.S. National Stage filing from application PCT/GB11/01582 filed Nov. 10, 2011 which claimed priority to British application number GB 1019053.6 filed Nov. 11, 2010. Application Ser. No. 13,884,224, PCT/GB11/01582 and GB 1019053.6 are hereby incorporated by reference in their entireties.

BACKGROUND

Field of the Invention

This invention relates to an inflation device for an inflatable article and in particular, though not exclusively, to an inflation device for life jackets and the like.

Description of the Prior Art

For life jacket inflation devices of the type which actuate automatically when submerged in water, and also for many inflation devices of the type which are manually actuated, it is well known to provide the inflation device with a small gas cylinder which is punctured in response to manual actuation or automatic actuation on contact with water so as to release pressurised gas for inflation of the life jacket.

Such inflation devices in general are reliable in use but there is the potential risk that following actuation the device is not properly serviced and fitted with a new gas cylinder.

In an attempt to address this problem and ensure that a user does not mistakenly use a life jacket for which the inflation device has a spent cylinder, or no cylinder at all, it is well known to provide the inflation device with a so-called "status" indicator.

One example of an inflation device having a status indicator is that of US patent application US 2003,0049981. That describes an automatic inflator having a cylinder adaptor provided with a fracturable collar and a mechanism which acts as a status indicator to establish whether or not that collar has been fractured. A particular disadvantage of an inflation device of this type is that it is complicated. A relatively expensive mechanism is needed in order to provide the required status indication and to confirm that a fully charged gas cylinder is present.

SUMMARY OF THE INVENTION

One object of the present invention is to provide an improved inflation device which effectively and more economically safeguards against the risk of the inflation device being used with an inflatable article when either a gas cylinder is absent from the inflation device or has a spent cylinder.

In accordance with one aspect of the present invention there is provided an inflation device for an inflatable article, said inflation device including a housing for supporting a container of pressurised fluid and for supporting piercing means which is displaceable from a retracted position to penetrate the container and allow release of pressurised fluid, said container being contained within a protective casing and said casing being non-releasably secured to the housing thereby to prevent removal of the container of pressurised fluid.

The expression "non-releasably secured" is used herein to mean that the casing is not designed to be removed from the housing either during normal use or as part of any maintenance or servicing operation.

Preferably the casing and or the housing is designed to ensure that in the event of the casing being removed by improper actions there is permanent damage to the casing and or housing such that the casing cannot be re-secured to the housing.

At least one of the casing and housing may enable the presence of a container within the casing to be confirmed by visual inspection. At least one of the casing and housing may be transparent, at least in part, for enabling the presence of a container within the casing to be confirmed by visual inspection. Preferably the casing is, at least in part, transparent and more preferably wholly transparent.

In addition or as an alternative to the feature of transparency for enabling the presence of a container within the casing to be confirmed by visual inspection, visual inspection may be facilitated by provision of an aperture that permits sight of a container within the casing. One or each of the housing and container may be provided with at least one aperture or the casing and housing may define therebetween at least one said aperture. The aperture may be an aperture which allows drainage of water from between the casing and container.

The inflation device may comprise an indicator to indicate whether the container, typically a cylinder, has been punctured either manually or automatically. Thus, in contrast to prior known devices that are intended to safeguard against attempted use with a spent cylinder or use in the absence of a cylinder, in accordance with the present invention it is sufficient for the inflation device merely to comprise an indicator for indicating whether or not there has been a manual or automatic actuation. There is no requirement to provide an indicator for sensing whether or not a cylinder is present.

The inflation device of the subject invention may be termed a "single use" inflation device. It may be described also as being of the type having a "factory fitted" container of pressurised fluid.

In addition to comprising a housing, the non-releasable casing and a container of pressurised fluid, typically the inflation device of the subject invention additionally will comprise an actuation mechanism which may be of a type well know per se and which may be of a manual, automatic or a combination of manual and automatic actuation mechanisms. One suitable type of mechanism is that the subject of our European patent EP 1109717B.

Another suitable mechanism is that of our co-pending UK patent application GB 1019087.4 entitled Inflation Device Mechanism.

The inflation device additionally may comprise an outlet port of a type for securing to an inflatable article such that when actuated the inflation device supplies pressurised fluid, such as carbon dioxide, from the container through the outlet port and into the inflatable article. Preferably the outlet port of the inflation device and, or the inflatable article for use therewith comprises selectively releasable retention means whereby the inflation device may be secured readily to an inflatable article and removed therefrom.

The retention means may be in the form of a clip comprising a pair of members acted on by bias means such as a mechanical spring whereby in use they are biased into engagement with retention formations of a manifold secured to an inflatable article. In an alternative construction the inflation device may comprise said retention formations and the clip may be supported by the manifold.

The protective casing may be non-releasably secured to the housing in a fluid-tight manner whereby ingress of water to within the casing is inhibited. Alternatively the cylinder casing may be secured to the housing in a non fluid-tight manner. One or more drainage apertures may be provided to allow for drainage of water from between the casing and pressurised container.

The protective casing may be non-releasably secured to the housing by means of an adhesive. Alternatively, or additionally, it may be secured by mechanical means. An example of a suitable mechanical means comprises a plurality of resilient fingers carried by either the casing or housing and which inter-lock with abutments provided by the other of the casing or housing when in an assembled condition.

DESCRIPTION OF THE FIGURES

Embodiments of the present invention will now be described, by way of example only, with reference to the accompanying drawings in which.

DESCRIPTION OF THE PREFERRED EMBODIMENTS

Figure 2:
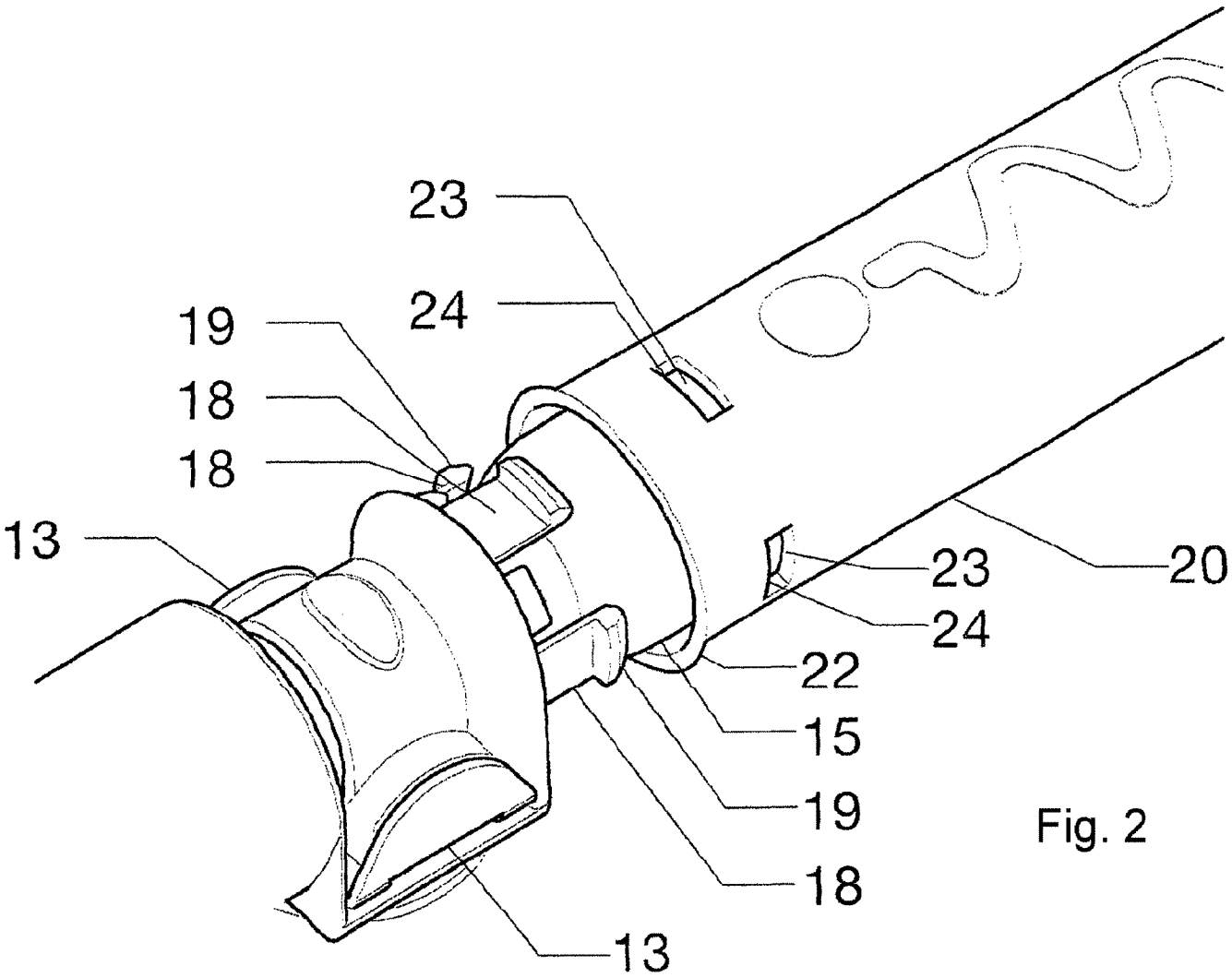
FIG. 2 is a perspective view showing in more detail a part of the device of FIG. 1 prior to final assembly.
Figure 3:
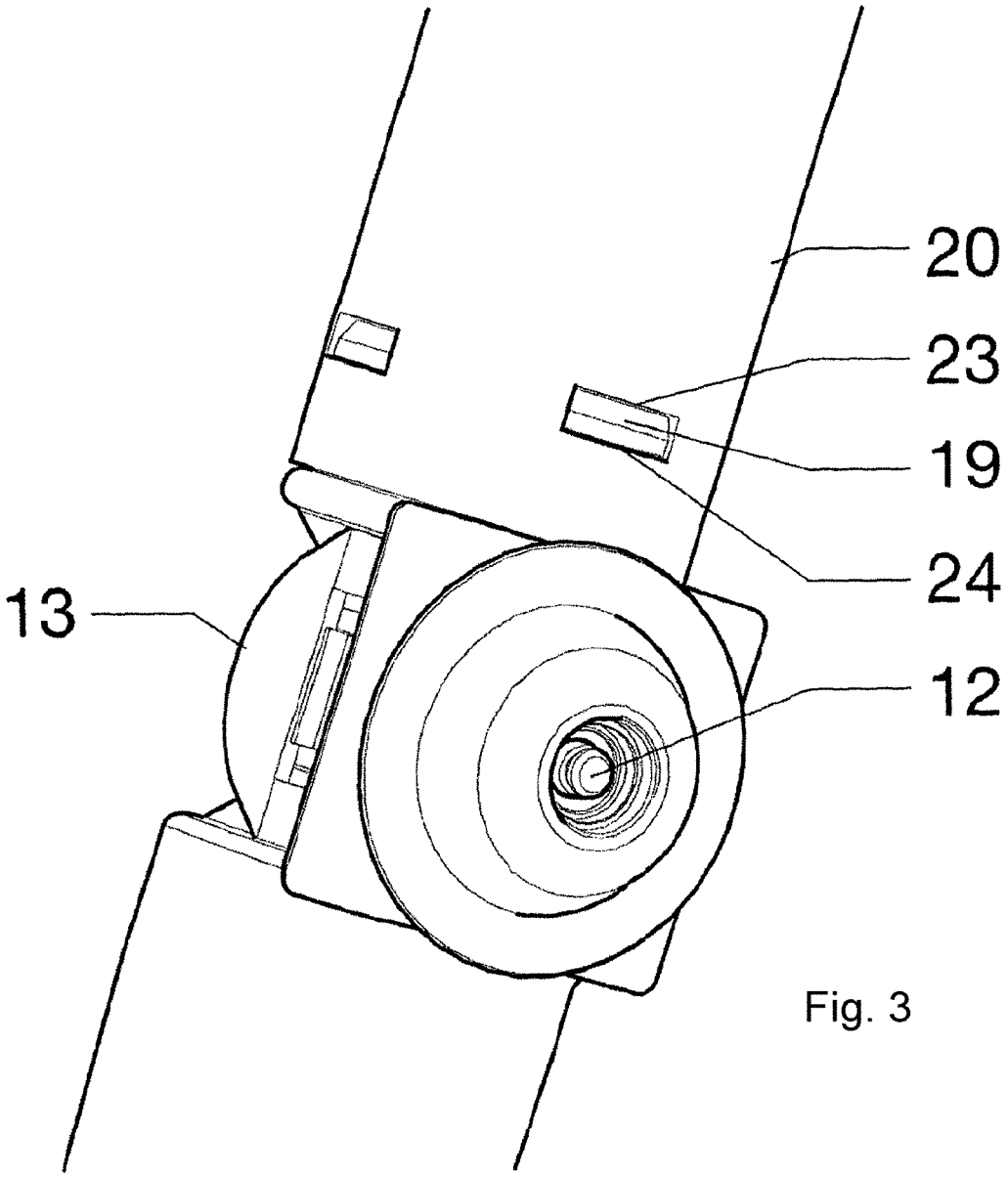
FIG. 3 is a perspective view of a part of the inflation device of FIG. 1 from a direction substantially opposite that of FIG. 2.

An inflation device 10 (see FIGS. 1 to 3) suitable for selectively releasably securing to the manifold (not shown) of an inflatable article such as a life jacket or the like comprises a housing 11 having an outlet port 12.

The housing 11 is provided with a slot formation which guides a retainer 13 comprising a pair of spring-loaded retention clips which are operable to engage with formations on a manifold thereby to secure the inflation device to the inflatable article in a selectively releasable manner. Thus when secured to a manifold pressurised gas may flow through the outlet port 12 and into the inflatable article.

A fluid seal is provided in a conventional manner to ensure a fluid-tight connection between the inflation device 10 and manifold.

The retainer 13 (see FIG. 4) comprises two clips 30 each having a planar portion 31 formed with a profiled cut-out. Each profiled cut-out is shaped to provide a pair of parallel guide surfaces 33 to engage with a guide pin 34 carried by the other of the two clips, abutment edge regions 35 to engage in use with a manifold when the two clips are in a first position relative to one another, substantially as shown in FIG. 4, and edge regions 36 which are spaced sufficiently to allow ease of fitting of the retainer over the end of a manifold when the two clips are in a second position relative to one another.

Figure 4:
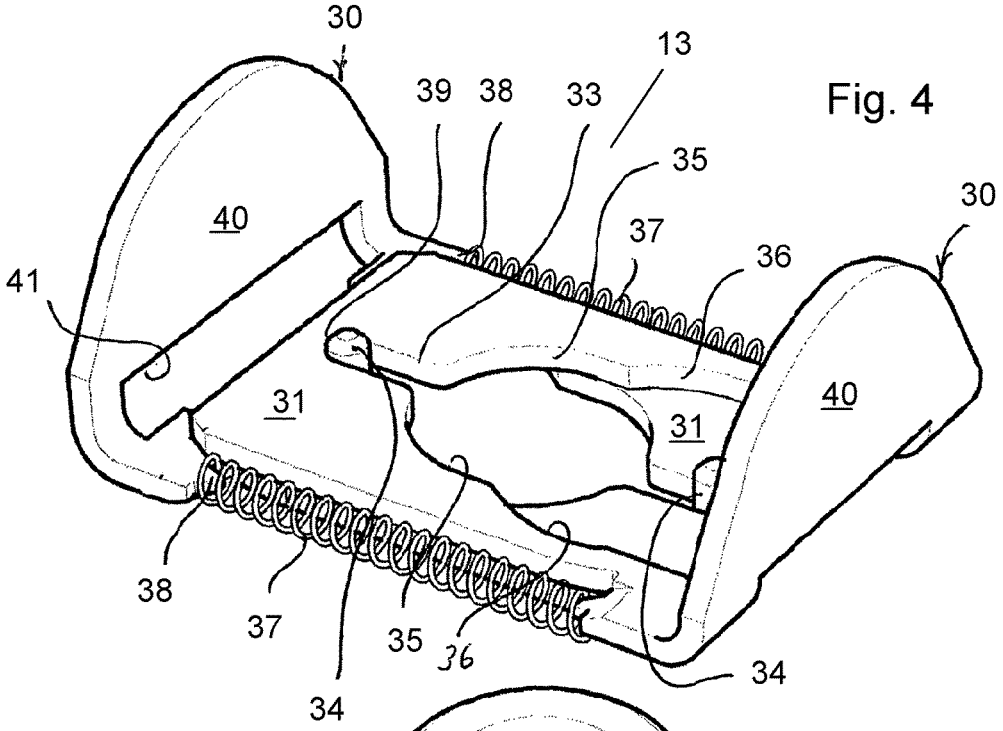
FIG. 4 is a perspective view of the retainer of the inflation device of FIGS. 1 to 3.

The two planar portions 31 are slidable relative to one another and are urged to the first position as shown in FIG. 4 by the action of a pair of compression springs 37 which act between the protrusions 38 of the clips. Sliding movement under the action of the two springs is restricted by the pins 34 engaging with abutment surfaces 39 at ends of each pair of guide surfaces 33.

To facilitate movement of the two clips against the direction of the bias force provided by the springs, and thus to move the abutment surfaces towards one another, each clip has an apertured end region 40. One of the end regions 40, namely that of the clip whose planar portion lies under the planar portion of the other clip as viewed in FIG. 4, is provided with a cut-out region 41 so that an end of the other clip may freely slide therethrough. For manufacturing convenience the other, upper clip may be of the same shape and similarly provided with a cut-out 41. The upturned regions 40 provide convenient surfaces for a user to press against to move the two clips to the second position for fitting to and removal from a manifold.

In addition to the guidance provided by the pins 34 the two planar portions are prevented from separation by being located in the aforementioned slot formation of the housing. Thus the clips are slidable relative to one another in a direction at right angles to the longitudinal direction of the housing 11.

Figure 5:
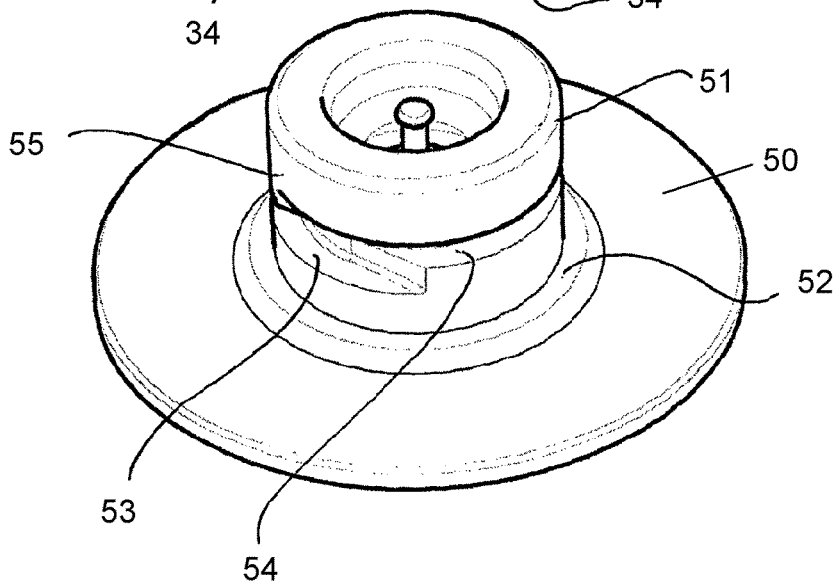
FIG. 5 is a perspective view of the manifold of an inflatable article.
Figure 6:
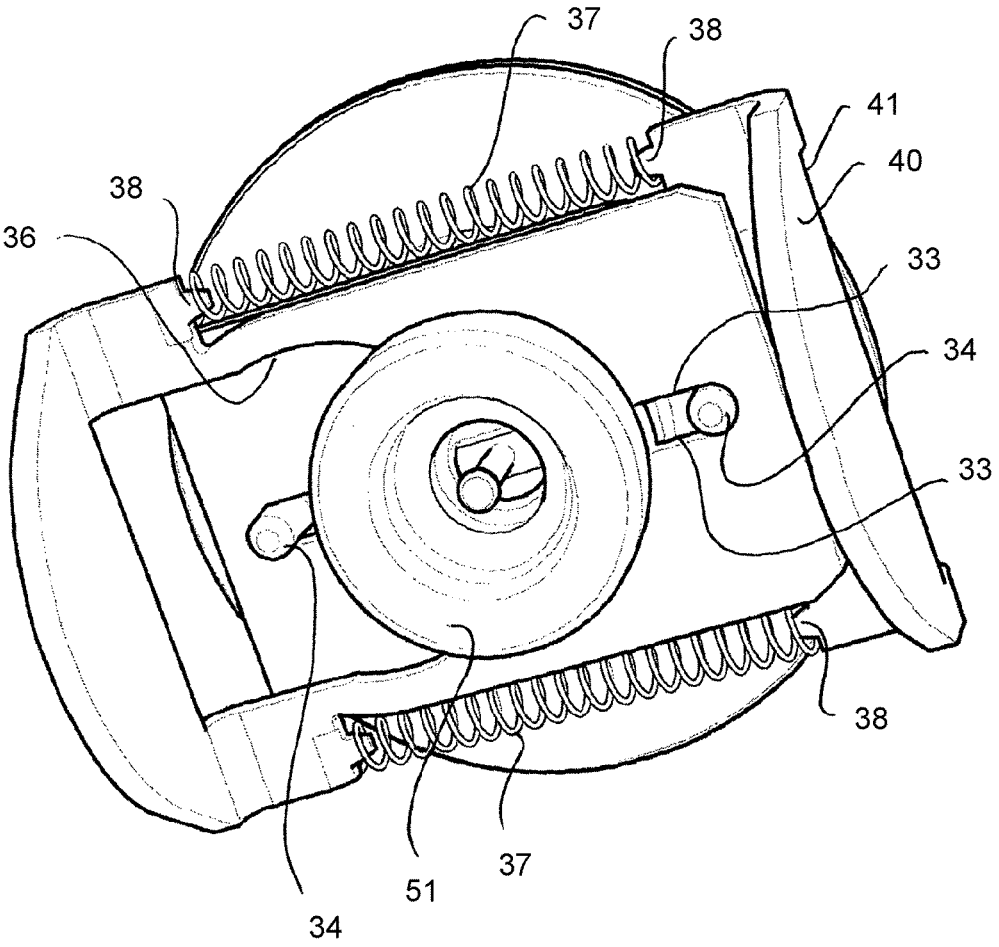
FIG. 6 is a perspective view showing the retainer of FIG. 4 secured to the manifold of FIG. 5.

In use to attach the inflation device 10 to a manifold 50 (see FIGS. 5 & 6) the clip ends 40 are pressed towards one another against the bias force exerted by the springs 38 such that the pairs of edge regions 36 are aligned thereby to allow the clips, and thus the inflation device to pass over the end 51 of the manifold. The housing then abuts the manifold shoulder region 52 whereupon release of the clip ends and rotation of the housing relative to the manifold allows the clip abutment edge regions 35 each to align and engage with a respective one of the grooves 53,54 that each extend around a part of the circumference of a tubular stem portion 55 of the manifold.

The housing 11 additionally comprises an inlet port 14 to which a carbon dioxide cylinder 15 is secured to form a seal therewith. The inlet port is surrounded by an array of at least three and in this case four uniformly circumferentially spaced resilient fingers 18 having end abutments 19 for retention of a cylinder casing 20.

The cylinder casing 20 is formed from a moulded transparent material such as high impact polypropylene. A distal end 21 of the casing is closed (see FIG. 1). The other end 22 of the casing is open ended and is provided with four circumferentially uniformly spaced slots 23 which each define an abutment surface 24 to co-operate with an outwardly directed abutment end 19 of a respective end of the four fingers 18 (see FIGS. 2 and 3). In the assembled condition the four abutment fingers prevent subsequent removal of the casing.

The housing contains a firing mechanism (not shown) which may be actuated to pierce a seal (not shown) at the inner end of the gas cylinder 15 and thereby cause pressurised carbon dioxide to flow through the housing and, via the outlet port 12, into the inflatable article to which the inflation device is secured.

Actuation of the firing mechanism is by means of a mechanism which provides for both automatic actuation in the event of the inflation device being submerged in water and also for manual operation in the event of the toggle 26 being pulled.

Figure 1:
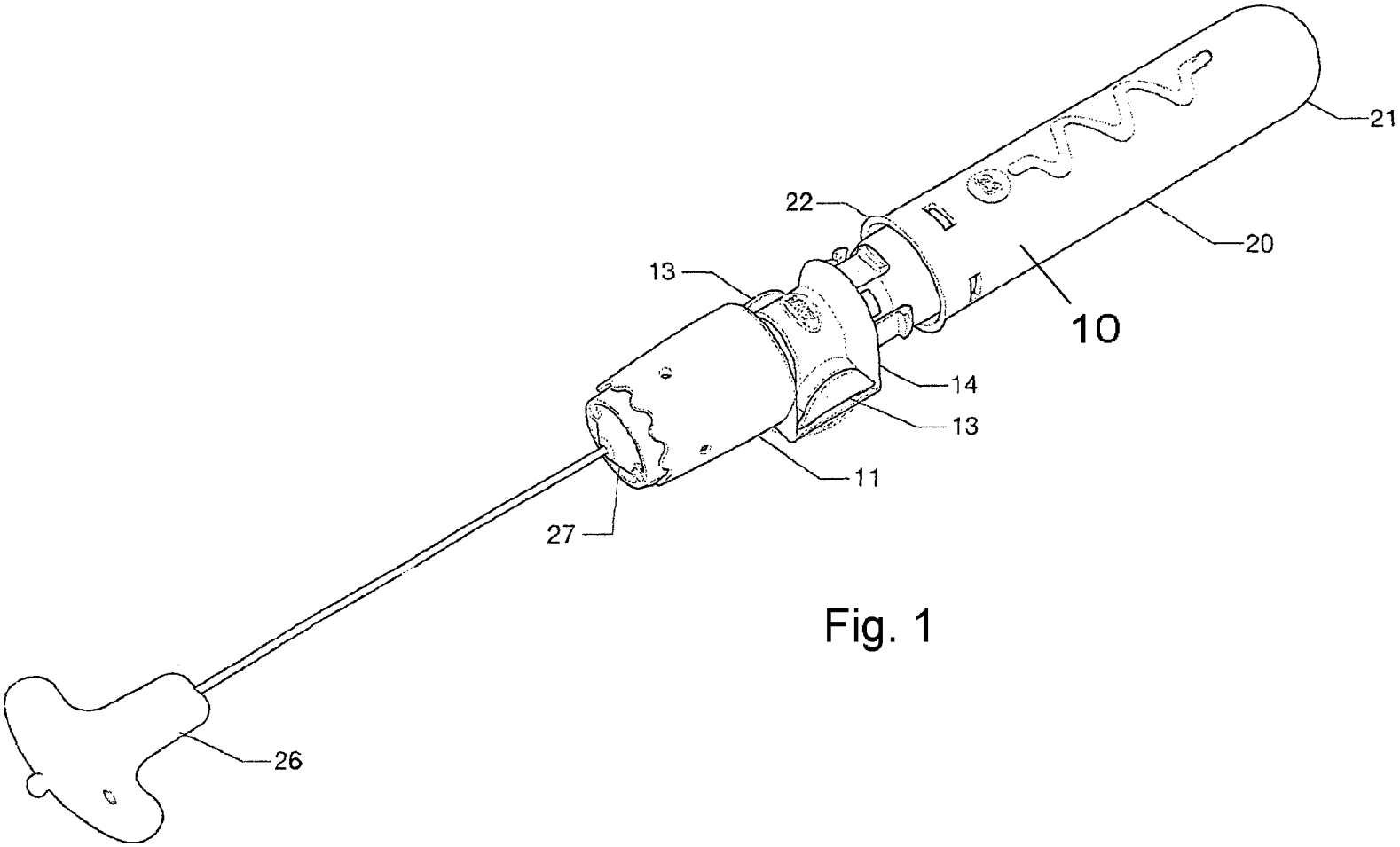
FIG. 1 is a perspective view of an inflation device in accordance with the present invention prior to final assembly.

The firing mechanism has incorporated therewith an indicator which is of a kind that provides a clear visible indication that there has been either manual or automatic actuation of the firing mechanism. In this embodiment that indication is provided by means of a plastics end cap 27 which prior to actuation lies flush with an end of the housing but protrudes (as shown in FIG. 1) from the end of the housing subsequent to actuation. A light spring may be provided within the housing to effect that protrusion in the event of an automatic actuation.

In the event of operation of the firing mechanism the displaced position of the indicator cap 27 therefore clearly and simply signifies the need to remove and replace the inflation device as a complete unit. Because the gas cylinder is non-releasably secured to the housing there is no risk of the inflation device being re-assembled with a spent cylinder, and the transparency of the casing gives a clear confirmation that a cylinder is present without the need to provide a complex sensing mechanism In the described embodiment the provision of four, or at least three, fingers 18, in contrast for example to only a single retention finger inhibits unauthorised removal of the casing 20. However, as an added safeguard against any unauthorised attempt simultaneously to depress inwards each of the four of the abutment ends 19, the outer surface of the casing end region 22 may be moulded to provide a thickened annular zone whereby each of the slots 23 is covered by the casing material.

Although in this described embodiment the casing is secured by four fingers 18 which provide a mechanical interlock, it is to be understood that alternative forms of mechanical interlock and or adhesion may be employed to inhibit unauthorised removal of a casing.

Figure 7:
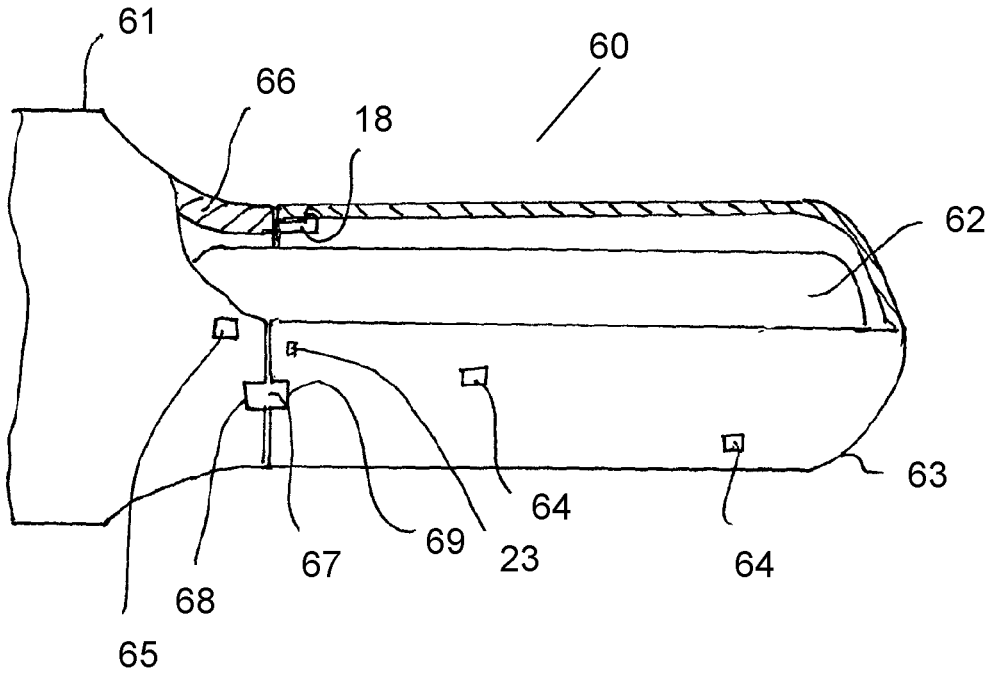
FIG. 7 is a side view, part in section, of part of an inflation device in accordance with a second embodiment of the present invention.

In a second embodiment of the present invention (see FIG. 7) an inflation device 60 comprises a housing 61 to which a gas cylinder 62 is screw fitted, and the cylinder is contained within a protected casing 63 which is non-releasably secured to the housing 61. Although optionally the casing 63 may be wholly or in part of transparent material for allowing visual confirmation that a cylinder 62 is present within the casing, in this embodiment one or more apertures are provided for the purpose of said visual inspection.

The or each aperture may be in the form of an aperture 64 defined wholly by the casing, or in the form of an aperture 65 defined by a skirt portion 66 of the housing where it surrounds an inner end of the container, or in the form of an aperture 67 defined by confronting surfaces 68, 69 of the housing and casing.

The retainer described herein may be used in conjunction with the housings of other types of inflation devices and is not specific in applicability to use with an inflation device having an automatically and manually actuated firing mechanism.

I claim:

1. A single use inflation device, said inflation device including a housing for supporting a container of pressurized fluid and for supporting a piercing member that displaces from a retracted position to pierce the container and allow release of pressurized fluid, said container being contained within a protective casing, said casing and housing being adapted to prevent removal of the container from the inflation device when the casing is secured to the housing, said casing and housing being permanently attached together by a plurality of resilient fingers carried by at least one of the casing and housing and which interlock with the other of the casing and housing to prevent removal of the container of pressurized fluid from the device, and wherein the inflation device includes an outlet port adapted to be secured to an inflatable article for flow of pressurized fluid into the inflatable article from the container of pressurized fluid and to be removed from the inflatable article wherein said outlet port of the inflation device comprises a coupling whereby the inflation device may be secured to an inflatable article and removed therefrom;

and wherein said coupling comprises a pair of members biased in a first direction by a mechanical spring.

2. An inflation device according to claim 1 wherein at least one of the casing and housing also enables the presence of a container within the casing to be confirmed by visual inspection.

3. An inflation device according to claim 1 the protective casing is secured to the housing in a non-fluid tight manner.

4. An inflation device according to claim 3 and comprising at least one drainage aperture to allow drainage of water from between the casing and container.

5. An inflation device according to claim 1 wherein the protective casing is secured to the housing in a fluid tight manner.

6. An inflation device according to claim 1 wherein the protective casing is non-releasably secured to the housing additionally by means of an adhesive.

7. An inflation device according to claim 1 and comprising an indicator to indicate whether the container of pressurized fluid has been punctured.

8. An inflation device according to claim 7 wherein said indicator acts to indicate whether or not there has been actuation of the piercing member to penetrate the container and allow release of pressurized fluid.

9. An inflation device according to claim 1 and comprising a manual actuator attached to the housing or casing and adapted to cause the piercing member to pierce the container of pressurized fluid.

10. An inflation device according to claim 1 and comprising an actuator operable automatically in response to contact with water to cause operation of the piercing member to pierce the container and allow release of pressurized fluid.

11. An inflation device according to claim 1 wherein at least in part at least one of the casing and housing is transparent.

12. An inflation device according to claim 1 wherein at least one of the casing and housing at least in part defines an aperture for enabling the presence of a container within the casing to be confirmed by visual inspection.

13. A single use inflation device, said inflation device including a housing for supporting a container of pressurized fluid and for supporting a piercing member which displaces from a retracted position to pierce the container and allow release of pressurized fluid, said container being contained within a protective casing, said casing and housing being adapted to prevent removal of the container from the inflation device when the casing is secured to the housing, said casing and housing being permanently attached together by a plurality of resilient fingers carried by at least one of the casing and housing and which interlock with the other of the casing and housing to prevent removal of the container of pressurized fluid from the device, wherein the inflation device includes an outlet port adapted to be secured to an inflatable article for flow of pressurized fluid into the inflatable article from the container of pressurized fluid and to be removed from the inflatable article, and wherein at least in part at least one of the casing and housing is transparent;

wherein said outlet port of the inflation device comprises a coupling whereby the inflation device may be secured to an inflatable article and removed therefrom;

and wherein said coupling comprises a pair of members biased in a first direction by a mechanical spring.

14. An inflation device according to claim 13 wherein the protective casing is non-releasably secured to the housing additionally by means of an adhesive.

15. An inflation device according to claim 13 and comprising at least one drainage aperture to allow drainage of water from between the casing and container.

16. A single use inflation device, said inflation device including a housing for supporting a container of pressurized fluid and for supporting a piercing member moves from a retracted position to penetrate the container and allow release of pressurized fluid, said container being contained within a protective casing, said casing and housing being adapted to prevent removal of the container from the inflation device when the casing is secured to the housing, said casing and housing being permanently attached together by a plurality of resilient fingers carried by at least one of the casing and housing and which interlock with the other of the casing and housing to prevent removal of the container of pressurized fluid from the device, wherein the inflation device includes an outlet port adapted to be secured to an inflatable article for flow of pressurized fluid into the inflatable article from the container of pressurized fluid and to be removed from the inflatable article, and wherein at least one of the casing and housing at least in part defines an aperture for enabling the presence of a container within the casing to be confirmed by visual inspection;

wherein said outlet port of the inflation device comprises a coupling whereby the inflation device may be secured to an inflatable article and removed therefrom;

and wherein said coupling comprises a pair of members biased in a first direction by a mechanical spring.

17. A single use inflation device according to claim 16 wherein at least in part at least one of the casing and housing is transparent.

18. An inflation device according to claim 16 and comprising at least one drainage aperture to allow drainage of water from between the casing and container.

* * * * *